United States Patent [19]

Iwasaki et al.

[11] 4,064,411

[45] Dec. 20, 1977

[54] X-RAY TUBE FOR ANALYTIC USE

[75] Inventors: Kenji Iwasaki, Yokohama; Tsuna Sawa, Fujisawa; Sotaro Hijikata, Yokohama, all of Japan

[73] Assignee: Tokyo Shibaura Electric Co., Ltd., Kawasaki, Japan

[21] Appl. No.: 751,678

[22] Filed: Dec. 17, 1976

[30] Foreign Application Priority Data

Dec. 20, 1975 Japan ..... 50-152492

[51] Int. Cl.[2] ..... H01J 35/00

[52] U.S. Cl. ..... 313/32; 313/39; 313/55

[58] Field of Search ..... 313/32, 30, 39

[56] References Cited

U.S. PATENT DOCUMENTS 2,886,723 5/1959 Burley ..... 313/32

*Primary Examiner*—Rudolph V. Rolinec
*Assistant Examiner*—Darwin R. Horstetter
*Attorney, Agent, or Firm*—Oblon, Fisher, Spivak, McClelland & Maier

[57] ABSTRACT

An X-ray tube for analytic use comprises a bottomed cylindrical nozzle which is formed at the bottom with a slit having substantially the same shape and size as that of a focus formed on an electron-impact surface of an anode target. A pair of recesses are formed out in the backside surface of the anode. The nozzle is provided on its outer periphery with a pair of engaging members fitted into the recess, respectively, to prevent the rotation of the nozzle relative to the anode target. Consequently, the nozzle is detachably fitted to the anode and rotated substantially together with the anode thus resulting in a sure alignment of the slit of nozzle with the focus of target.

9 Claims, 12 Drawing Figures

X-RAY TUBE FOR ANALYTIC USE

BACKGROUND OF THE INVENTION

This invention relates to an X-ray tube for industrial use, more particularly to an X-ray tube used for the X-ray analysis and the applications thereof.

An X-ray tube for analytic use is constructed into a type of stationary anode wherein the anode including a target is hermetically secured to one end of an air-sealed envelope. The X-ray tube for analytic use is subject to long-hours continuous use when it is applied. Therefore, the target is heated upto high temperature and is subject to forced cooling with cooling medium such as water supplied to a cooler fitted to the anode.

A known X-ray tube for analytic use is shown in FIG. 1, in which X-ray tube 10 comprises an anode 16 hermetically secured to one end of an air-sealed envelope 14 and having a target 12 arranged integrally therewith, and a cooler 18 fitted on the outer surface of anode to cool the anode. The main body of the X-ray tube is constructed of the envelope 14, the anode 16 and a cathode. The electron-impact surface of anode target 12 is perpendicularly positioned with respect to the axis of X-ray tube, opposing the filament 20 of the cathode. The electrons emitted from the filament 20 impinge on an electron impact surface 12*a*, to form thereon a linear focus, for example, 1 mm in width and 10 mm in length. The X-rays generated on the focus are radiated in all directions in the surrounding space. For picking the radiated X-rays up, four windows 22 are disposed at the metal part of the envelope 14. As a result, from two windows positioned in the longitudinal direction of the above-mentioned linear focus, are radiated X-rays whose configuration at the focus is dotshaped, while from the other two windows positioned perpendicular to the longitudinal direction are radiated linear-shaped X-rays. These windows 22 are changeable-over according to the purpose of the use of X-ray tube.

The change-over of the windows is carried out by keeping the cooler 18 which concurrently serves as a fitting table in its stationary position and turning the main body of X-ray tube 10 through a degree of 90°.

The cooler 18 is made of a square plate, to whose central part is fixed an upright pipe 24 extended into the target 12. A flow passage 26 for supplying cooling medium to the upright pipe 24 is bored in the cooler 18. The cooling medium flows from an inflow passage 26*a* into the bottom part of pipe 24 and releases from the tip end of the pipe into the backside of the target corresponding to the electron-impact surface thereof, thereby cooling the target 12. The cooling medium after having absorbed the heat of the target 12 flows collectively into the outflow passage 26*b* to be discharged outside.

The upright pipe 24 is made of a cylindrical member having an inner diameter equal to or larger than the length of the focus in the longitudinal direction, so as to cool reliably the backside surface of target corresponding to the electron-impact surface of target, i.e., the focus, even when the main body of X-ray tube has been turned about the axis thereof. However, due to the large exit of cooling medium of pipe 24, a large quantity of cooling medium is necessary and the cooling efficiency is consequently low.

In order to raise the cooling efficiency to eliminate the above-mentioned disadvantages, as shown in FIG. 2 an X-ray tube 27 for analytic use is reported which comprises a bottomed cylindrical nozzle 30 provided at the bottom with a slit 28 having substantially the same shape and size as that of the focus and fitted over the upright pipe 24. The nozzle 30 is integrally provided with a plurality of, for example, four projection pieces 31 on the outer circumference of its bottom part so as to provide a cooling medium releasing space between the bottom of the nozzle and the target. Further, the nozzle 30 is integrally provided on its inner wall with a plurality of, for example, four axial pieces fitted into four axial grooves (not shown) formed in the outer periphery of the upright pipe 24 and spaced 90° from each other in the circumferential direction of the nozzle so as to align the focus with the slit 28.

With this type of X-ray tube 25, the cooling medium is released through the slit which is brought into alignment with the focus and has substantially the same shape and size as that of the focus. Therefore, the released cooling medium collides with the whole backside surface of target corresponding to the focus thus making it possible to cool the target 12 effectively.

However, with the X-ray tube 25, when the main body thereof is set at a position turned 90° with respect to its fitting table, i.e., the cooler 18, for picking a different focus shape of radiated X-rays up, the nozzle 30 has to be also turned simultaneously through a degree of 90° so as to be fitted into the upright pipe 24.

If an operator should forget the corresponding turn of the nozzle 30, the released cooling medium will not strike against the whole corresponding backside surface of focus, resulting in the failure of sufficient cooling to cause the target 12 to be burned and damaged due to over-heating. Such danger is involved unavoidably in this type of X-ray tube 25.

It is therefore an object of this invention to provide an X-ray tube for analytic use capable of cooling the target effectively without causing damages to the same due to overheating. For achieving the aforesaid purpose, the X-ray tube for analytic use according to the present invention comprises a nozzle with slit, the nozzle detachably fitted to an anode so as to align the slit with the focus of electron impact surface of target. Since the nozzle is attached to the anode, when the main body of X-ray tube is turned, the nozzle is nescessarily integrally turned jointly with the anode as one part of the main body whereby the alignment of the slit and the focus always is necessarily kept thus to prevent the target from being damaged due to overheating.

Other objects, features and advantages of this invention will become apparent as the description thereof proceeds when considered in connection with the accompanying drawings..

DETAILED DESCRIPTION OF THE PREFERRED EMBODIMENTS

Figure 1:
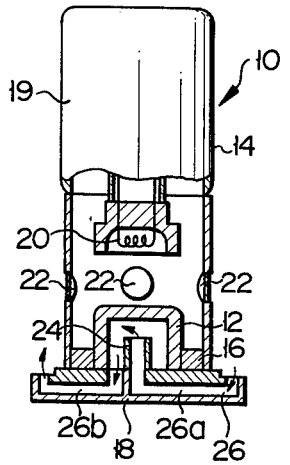
FIG. 1 PRIOR ART
FIG. 1 is a front view, partly in cross section, of a known X-ray tube for analytic use.
Figure 2:
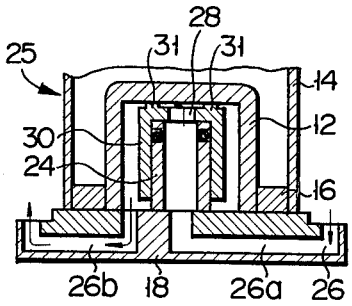
FIG. 2 PRIOR ART
FIG. 2 is a fragmentary longitudinal sectional view of another known X-ray tube for analytic use.
Figure 3:
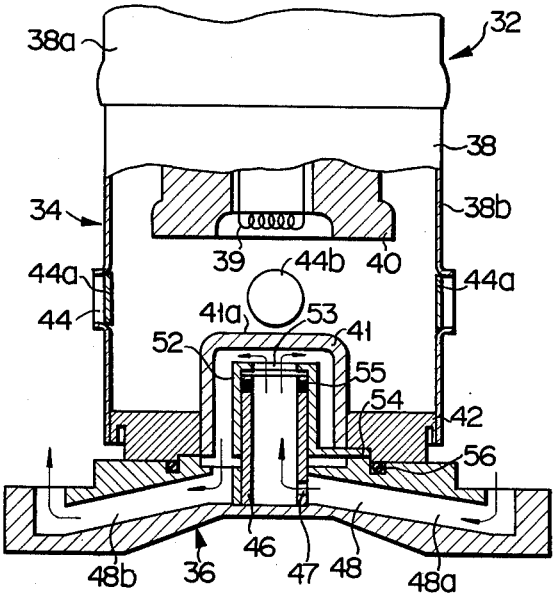
FIG. 3 is a fragmentary longitudinal sectional view of an X-ray tube for analytic use according to one embodiment of this invention.

The main section of an X-ray tube for analytic use according to one embodiment of this invention is shown in FIG. 3.

An X-ray tube 32 for analytic use comprises a main body 34 and a cooler 36 forming a fitting table for fitting the main body thereto. The main body 34 includes an air-sealed envelope 38 consisting of a glass part 38a and a metal part 38b, a cathode 40 hermetically secured to an end glass part 38a of the envelope 38 provided with a filament 39 at the central portion of a free-end thereof, and an node 42 hermetically secured to an end of the metal part 38b of the envelope 38 is integrally provided with a target 41 opposing the filament 39. The anode target 41 is formed into a bottomed cylindrical shape having an electron-impact surface 41a intersecting the axis of main body 34 perpendicularly thereto. At the level slightly displaced toward the cathode side from the electrom-impact surface 41a are provided on the metal part 38b of the envelope 38 four X-ray radiating windows 44 of beryllium, in a state spaced 90° from one another in circumferential direction. The electrons generated due to the heating of the filament 39 impinge upon the electron-struck surface 41a of the target opposing the filament 39, thereby forming a linear focus to generate X-rays, and these X-rays are radiated from the focus in all directions in the surrounding space. As a result, from the two windows 44a positioned in the longitudinal direction of the above mentioned linear focus are radiated X-rays having a dot-like configuration, while from the other two windows 44b positioned perpendicular to the longitudinal direction are radiated X-rays having a linear configuration.

The cooler 36 is formed of square-shaped plate to whose central part is fixed an upright pipe 46. An inflow hole 47 is bored in the side wall of the fixed end portion of upright pipe 46. Bored in the cooler 36 is a fluid passage 48 comprising an inflow passage 48a for sending cooling medium into the inflow hole 47 and an outflow passage 48b for exteriorly releasing the cooling medium having cooled the backside surface of target corresponding to the focus. And the cooler 36 is detachably bolted to the outer surface of the anode of the main body 34 of X-ray tube 32, so as to allow the upright pipe 46 to be extended into the anode target 41.

Figure 4:
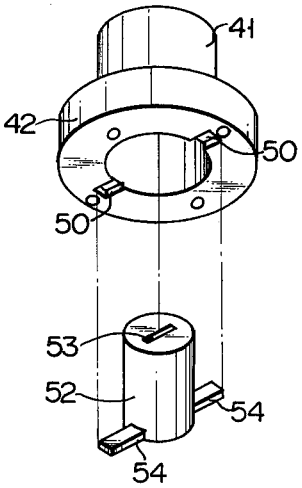
FIG. 4 is a perspective view showing the fitting of the nozzle to the anode.

As shown in FIG. 4, in the outer surface of anode 42 are formed a pair of radial recesses 50 rectangular in crosssection, the recesses facing each other in diametrical direction. The recesses 50 are positioned in the longitudinal direction of the linear focus on the electron-impact surface 41a. Between the upright pipe 46 and target 41 is disposed a bottomed cylindrical nozzle 52, whose bottom part is formed with a slit 53 having substantially the same shape and size as that of the focus on the electron-impact surface. At the opening end of nozzle 52 are integrally formed a pair of flange pieces 54 diametrically opposing each other and fittable into recesses 50, respectively. (In FIG. 3 only one piece is shown because the figure is right-angularly cut away.) The flange pieces 54 are positioned in the longitudinal direction of slit 53. When the nozzle 52 is positioned between the upright pipe 46 and the target 41 so as to permit each of the pieces 54 to be fitted into its corresponding recess 50, the slit 53 is brought into complete alignment with the focus of the electron-impact surface 41a.

As shown in FIG. 3, the cooling medium flows from the inflow passage 48a into the pipe 46 through the inlet hole 47 thereof, and is then jetted through the opening end of pipe 46 and the slit 53 of nozzle 52 to the backside surface of target corresponding to the focus of electron-impact surface 41a. The jetted cooling medium is hitted upon the backside surface corresponding to the focus to deprive the target 41 of its heat and then is released outside from the outflow passage 48b cooler through the ring-like space between the nozzle and target 48. Reference numerals 55, 56 indicate O-rings for use in sealing, respectively.

As above-described, the X-ray tube according to this invention, comprises a nozzle 52 with slit 53 having substantially the same shape and size as that of the focus, the nozzle being integrally assembled with the anode 42 in such a manner that the slit is arranged in alignment with the focus. If the nozzle 52 and anode 42 which constitutes one part of the main body 34 are so assembled, even when the main body 34 is turned, the slit is always kept in alignment with the focus and there is no risk of the slit intersecting the focus thereto as in the conventional case. Since the pair of flange pieces 52 are fitted into the pair of recesses 50 on the outer surface of anode, respectively, the bolted engagement can be released easily to separate the main body 34 from the cooler 36 thus to readily detach the nozzle therefrom. When plugging has occured in slit 53, the nozzle can be easily cleaned. Further, only one pair of recesses 50 are formed on the longitudinal direction of focus; and only one pair of flange pieces 52 of nozzle being fitted into the recesses are positioned in the longitudinal direction of slit 53. As a result, the slit is necessarily brought into alignment with the linear focus thus to eliminate the risk of misassembling. Needless to say, when the recesses 50 are disposed perpendicularly to the longitudinal direction of the linear focus the flange pieces 52 must be also disposed perpendicularly to the longitudinal direction of the slit 53.

Figure 5A:
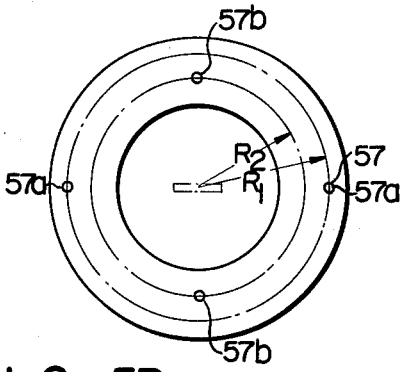
FIGS. 5*A* and 5*B* are bottom views of the main body of X-ray tube and the cooler, for explaining the method of fixing the main body to the cooler which serves as a fitting table.
Figure 5B:
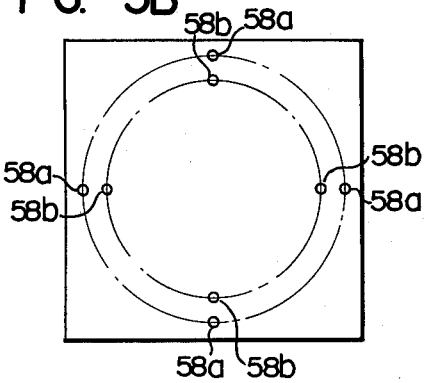

The mounting of the main body 34 onto the cooler 36 which concurrently serves as a fitting table can be effected as follows. As shown in FIG. 5A, bored in the outer surface of anode 43 are four threaded holes 57 spaced from one another at 90° in the circumferential direction of the anode. The threaded holes 57 consist each of one pair of threaded holes 57a, 57b which are positioned on a concentric circle. $R_1$ designates a radius of the circle on which are positioned the pair of threaded holes 57a located longitudinally of the focus (shown by one-dot line) on the electron-impact surface of target. The radius $R_1$ is larger than the radius $R_2$ of the circle on which are positioned the pair of threaded holes 57b situated in a direction intersecting the longitudinal direction of the focus at right angles thereto. On the other hand, as shown in FIG. 5B, the cooler 36 is bored concentrically with mounting holes 58 each consisting of four smooth through holes 58a, 58b spaced 90° from one another. The smooth through holes 58a are positioned on the circle having the radius $R_1$ and the smooth through holes 58b are positioned on the circle having the radius $R_2$, respectively.

Figure 6A:
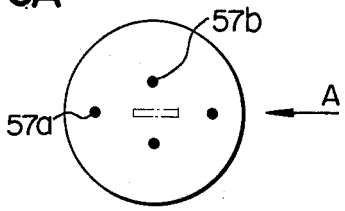
FIGS. 6A, 6B, 7A and 7B are views for explaining the screwed conditions of bolts, respectively.
Figure 7A:
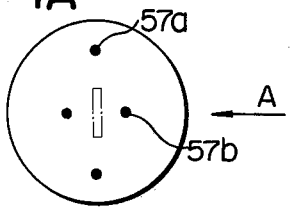
Figure 6B:
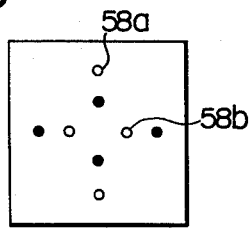
Figure 7B:
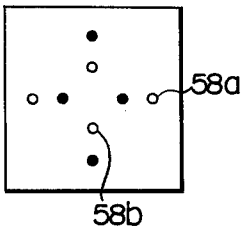

Where, therefore, as shown in FIG. 6A, the direction indicated by arrow A lies longitudinally of the focus, bolts (not shown) are screwed, as seen from FIGS. 6A, 6B into the threaded holes 57*a*, 57*b* through those of the smooth through holes 58*a*, 58*b* which are shown in black dots.

Where the direction indicated by arrow A lies perpendicularly to the longitudinal direction of the focus, bolts (not shown) are screwed, as seen from FIGS. 7A, 7B, into the threaded holes 57*a*, 57*b* through those of the smooth through holes 58*a*, 58*b* which are shown in black dots. For the sake of clarification, these threaded holes 57*a*, 57*b* are shown in black dots in any case.

If the main body is mounted to the cooler 36 in such a way as above-mentioned, the attached or fitted condition of bolts to the cooler will become similar to the shape of the linear focus with the result that the longitudinal direction of the focus can be always confirmed thus giving a preferable effect in practical use. The bolts may be so fitted as to correspond to the direction of the windows through which the linear focus is to be obtained, without being allowed to the longitudinal direction of the focus. In this case, the focus is located at a position wherein the longitudinal axis thereof intersects that at the shown position perpendicularly thereto.

Figure 8:
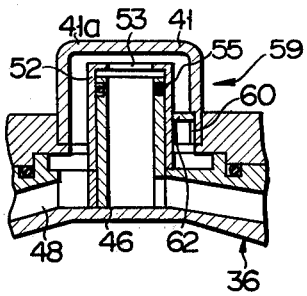
FIG. 8 is a fragmentary longitudinal sectional view of the X-ray tube for analytic use according to another embodiment of this invention.
Figure 9:
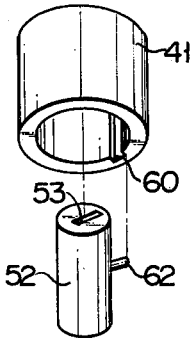
FIG. 9 is a perspective view similar to that of FIG. 4.

FIGS. 8, 9 show another embodiment of the invention. In the X-ray tube 59 of this embodiment, only one axial recess 60 rectangular in cross section is formed in the inner wall of anode target 41. One guide piece, for example, guide pin 62 is pressed into the hole on the outer wall of nozzle 52 at the central part thereof. The axial recess 60 and guide-pin 62 are of course positioned, in the longitudinal direction of the focus or the slit 53. The guide pin 62 has a diameter permitting itself to be fitted into the axial recess 60. The axial recess 60 of the target is so formed as to have a length which, when the nozzle 52 is disposed with the guide pin 62 fitted into the recess 60, permits the opening end of the nozzle to abut against the cooler 36 and the guide pin to abut against the upper end of the recess, as shown in FIG. 8. If the recess 60 is made into such a size as above-mentioned, then the position of nozzle 52 in the axial direction thereof can be regulated. The relative rotation of nozzle 52 with respect to the anode target 41 is of course prevented by the fitting of guide pin 62 into the recess 60.

Also in the X-ray tube 59 having the foregoing construction the slit 53 is always brought into alignment with the focus, and the nozzle 52 is easily detached for cleaning the slit 53. Since the guide pin 62 is simply pressed into the hole of outer wall bored on the nozzle 52, the nozzle attached with guide pin can be produced cheaply and quickly.

What we claim is:

1. An X-ray tube for analytic use which comprises an anode hermetically secured to one end of an air-sealed envelope and having a bottomed cylindrical target whose bottom is provided at its outer surface with an electron-impact surface on which electrons emitted from a cathode impinge, a cooler detachably fitted to an outer surface of the anode and having an upright pipe projected into the target and a fluid passage for cooling medium which flows from the tip end of the pipe thereinto and is released to a backside surface of the target corresponding to the electron-impact surface a bottomed cylindrical nozzle disposed between the pipe and target and having at its bottom part a slit having substantially the same shape and size as that of a focus formed on the electron-impact surface, and fitting means for detachably fitting the nozzle to the anode in a relation permitting the slit to be aligned with the focus.

2. An X-ray tube for analytic use according to claim 1, wherein the fitting means includes a recess formed in the anode and a fittable member formed on an outer peripheral surface of the nozzle and fitted into the recess, thereby preventing the rotation of the nozzle relative to the anode.

3. An X-ray tube for analytic use according to claim 2, wherein the fittable member of the fitting means is a flange piece integrally formed with the nozzle.

4. An X-ray tube for analytic use according to claim 3, wherein the recess of the fitting is formed in an outer surface of the anode in the radial direction thereof.

5. An X-ray tube for analytic use according to claim 3, wherein the recess of the fitting means is formed in an inner wall of the anode target in the axial direction thereof.

6. An X-ray tube for analytic use according to claim 2, wherein the fittable member of the fiting means is a guide piece pressed into a hole of the outer wall of the nozzle.

7. An X-ray tube for analytic use according to claim 6, wherein the recess of the fitting means is formed in an outer surface of the anode in the radial direction thereof.

8. An X-ray tube for analytic use according to claim 6, wherein the recess of the fitting means is formed in an inner wall of the anode target in the axial direction thereof.

9. An X-ray tube for analytic use according to claim 2, wherein the cooler is bored with two sets each of four smooth through holes on its two concentric circles, respectively, at the four holes of each set being located at an angle of 90° from each other in such a manner that one hole of one of the sets is in perfect alignment with one hole of the other of the sets, and on the outer surface of the anode at two sets each of two threaded holes spaced 180° from each other are bored two concentric circles having radii equal to those of concentric circles of the cooler, respectively, in a manner that one of the 180° angularly spaced holes on a larger one of the two concentric circles is positioned defining a right angle with that one of the 180° angularly spaced holes on a smaller one thereof which is not situated on a line connecting the center of one hole and the center of the circles.

* * * * *